US006866565B2

(12) United States Patent
Hirokawa et al.

(10) Patent No.: US 6,866,565 B2
(45) Date of Patent: Mar. 15, 2005

(54) POLISHING TOOL AND POLISHING APPARATUS

(75) Inventors: Kazuto Hirokawa, Tokyo (JP); Hiroshi Sakabe, Iwaki (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/352,852

(22) Filed: Jan. 29, 2003

(65) Prior Publication Data

US 2003/0143931 A1 Jul. 31, 2003

(30) Foreign Application Priority Data

Jan. 29, 2002 (JP) ..... 2002-020033
Jan. 29, 2002 (JP) ..... 2002-020034
Jan. 29, 2002 (JP) ..... 2002-020035

(51) Int. Cl.[7] ..... B24B 11/00
(52) U.S. Cl. ..... 451/41; 451/28; 451/285; 51/298
(58) Field of Search ..... 451/28, 41, 285–290, 451/298, 24; 51/298

(56) References Cited

U.S. PATENT DOCUMENTS 4,927,432 A * 5/1990 Budinger et al. ..... 51/298
5,830,045 A * 11/1998 Togawa et al. ..... 451/288
6,126,532 A * 10/2000 Sevilla et al. ..... 451/526
6,325,703 B2 12/2001 Cook et al. ..... 451/41
6,626,740 B2 * 9/2003 Baker et al. ..... 451/41

FOREIGN PATENT DOCUMENTS

JP 10-202536 8/1998

* cited by examiner

*Primary Examiner*—Joseph J. Hail, III
*Assistant Examiner*—Anthony Ojini
(74) *Attorney, Agent, or Firm*—Wenderoth, Lind & Ponack L.L.P.

(57) ABSTRACT

A polishing tool is used for polishing a workpiece in a state such that the workpiece is pressed against and brought into sliding contact with the polishing tool. The polishing tool is formed of thermoplastic resin having an average glass transition temperature (Tg) ranging from 270 K to 400 K. The thermoplastic resin includes a first phase having a low glass transition temperature (Tg) of 320 K or lower within a range of from 10 weight % to 90 weight %, and a second phase having a high glass transition temperature (Tg) of 320 K or higher within a range of from 90 weight % to 10 weight %.

18 Claims, 3 Drawing Sheets

POLISHING TOOL AND POLISHING APPARATUS

BACKGROUND OF THE INVENTION

1. Field of the Invention

The present invention relates to a polishing tool and apparatus for polishing a workpiece to be polished, such as a semiconductor wafer, to a flat mirror finish. More particularly, the invention relates to polishing technology using a polishing tool containing thermoplastic resin therein, such as a fixed abrasive or a polishing pad.

2. Description of the Related Art

As semiconductor devices have become more highly integrated in recent years, circuit interconnections have become finer and dimensions of devices to be integrated have become smaller. From this point of view, it may be necessary to polish and planarize a surface of a semiconductor wafer to remove a film (layer) formed on the surface of the semiconductor wafer. In order to planarize a surface of a semiconductor wafer, a polishing apparatus for performing chemical mechanical polishing (CMP) has been used. This type of chemical mechanical polishing (CMP) apparatus comprises a polishing table having a polishing pad (polishing cloth) attached thereon, and a top ring for holding a workpiece to be polished, such as a semiconductor wafer. The workpiece is disposed between the polishing pad and the top ring, and pressed against the polishing pad under a certain pressure by the top ring while the polishing table and the top ring are rotated. In this state, the workpiece is polished to a flat mirror finish while a polishing liquid (slurry) is supplied onto the polishing pad.

In a chemical mechanical polishing process as described above, a workpiece is polished while a polishing liquid (slurry) containing a large amount of abrasive particles is supplied onto a relatively soft polishing pad. Therefore, a problem of pattern dependence arises. Pattern dependence means that gentle irregularities are formed on a surface of a semiconductor wafer after a polishing process due to irregularities on the surface of the semiconductor wafer that existed before the polishing process, thus making it difficult to planarize the surface of the semiconductor wafer to a completely flat surface. Specifically, a polishing rate is higher in an area where irregularities have small pitches (a density of irregularities is large) and is lower in an area where irregularities have large pitches (a density of irregularities is small). Existence of areas of the higher polishing rate and areas of the lower polishing rate causes gentle irregularities to be formed on the surface of the semiconductor wafer.

In recent years, it has also been a common practice to polish a semiconductor wafer with use of a fixed abrasive (grindstone). In such a process, a surface of a semiconductor wafer or the like is polished with a fixed abrasive which comprises abrasive particles fixed by a resin as a binder. Since a semiconductor wafer is thus polished mainly by abrasive particles released from a binder in a fixed abrasive, a polishing liquid (slurry) is not basically required to be supplied onto a surface of the fixed abrasive during polishing. With a process utilizing a fixed abrasive which essentially has a large hardness, it is possible to achieve a considerably higher level of planarity. On the other hand, with the process utilizing a fixed abrasive, scratches or defects tend to be produced on a surface of a semiconductor wafer being polished.

SUMMARY OF THE INVENTION

The present invention has been made in view of the above drawbacks. It is, therefore, an object of the present invention to provide a polishing tool and apparatus which can achieve a stable polishing rate, a high level of planarization, and flat characteristics, and can effectively prevent defects (scratches) from being produced on surfaces, to be polished, of various kinds of workpieces including semiconductor wafers.

According to a first aspect of the present invention, there is provided a polishing tool for polishing a workpiece in a state such that the workpiece is pressed against and brought into sliding contact with the polishing tool. The polishing tool is mainly composed of thermoplastic resin having an average glass transition temperature (Tg) ranging from 270 K to 400 K. An average glass transition temperature (Tg) is calculated from a weight ratio of monomers contained in thermoplastic resin based on Fox formula which will be described later.

According to a second aspect of the present invention, the polishing tool is mainly composed of thermoplastic resin including a first phase having a low glass transition temperature (Tg) of 320 K or lower within a range of from 10 weight % to 90 weight %, and a second phase having a high glass transition temperature (Tg) of 320 K or higher within a range of from 90 weight % to 10 weight %.

According to a third aspect of the present invention, the polishing tool is mainly composed of thermoplastic resin, which is produced by aromatic vinyl type monomers in a range of from 0 weight % to 80 weight %, at least one of acrylic ester type monomers and methacrylic acid ester type monomers in a range of from 0 weight % to 100 weight %, and vinyl type monomers which can be copolymerized with the aromatic vinyl type monomers and the at least one of acrylic ester type monomers and methacrylic acid ester type monomers in a range of from 0 weight % to 50 weight %. The thermoplastic resin has a weight average molecular weight ranging from 5,000 to 5,000,000.

According to a preferred aspect of the present invention, the thermoplastic resin comprises linear macromolecules.

The polishing tool may comprise a fixed abrasive element having abrasive particles contained therein, or a polishing pad having substantially no abrasive particles therein.

According to a fourth aspect of the present invention, there is provided a polishing apparatus for polishing a workpiece. The polishing apparatus comprises the aforementioned polishing tool and a top ring for holding and pressing a workpiece against the polishing tool to bring the workpiece into sliding contact with the polishing tool.

Thermosetting resin, such as polyvinyl alcohol (PVA), phenolic resin, or epoxy resin, has heretofore been used widely in a conventional polishing tool for polishing a workpiece such as a semiconductor wafer. According to the present invention, thermoplastic resin is used instead of thermosetting resin. In particular, the polishing tool according to the present invention is formed of a multiphase resin having an average glass transition temperature ranging from 270 K to 400K. The polishing tool according to the present invention has good performance as compared to the conventional polishing tool.

Heat is developed when a workpiece such as a semiconductor wafer is polished. According to the present invention, thermoplastic resin having an average glass transition temperature (Tg) lower than a temperature during actual polishing is used in a polishing tool such as a fixed abrasive or a polishing pad. When the temperature of the thermoplastic resin in the polishing tool is increased to a temperature higher than the average glass transition temperature thereof, the polishing tool becomes more flexible. Thus, a workpiece can be polished with a soft polishing surface on the polishing tool, and hence scratches are prevented from being produced on a surface of the workpiece.

According to a fifth aspect of the present invention, there is provided a method comprising polishing a workpiece in a state such that the workpiece is pressed against and brought into sliding contact with a polishing tool mainly composed of thermoplastic resin. The atmospheric temperature around the polishing tool is adjusted during the polishing so as to be higher than a glass transition temperature of the polishing tool.

When the atmospheric temperature near the polishing tool is adjusted during the polishing so as to be higher than a glass transition temperature of the polishing tool, the polishing tool changes in physical properties and obtains a rubber-like form. Specifically, flexibility and capability of absorbing impact can be increased. Therefore, when the polishing tool mainly composed of thermoplastic resin is used at temperatures higher than a glass transition temperature thereof, scratches can be prevented from being produced during polishing of a workpiece such as a semiconductor wafer.

In order to increase the temperature of the polishing tool to a temperature higher than a glass transition temperature thereof, a liquid or a gas having a temperature higher than the glass transition temperature of the polishing tool may be supplied to a surface of the polishing tool. Alternatively, a workpiece to be polished may be heated to a temperature higher than the glass transition temperature of the polishing tool. For example, a heater may be provided in a top ring serving to hold a workpiece. Further, an infrared lamp may be used to heat the polishing tool. Alternatively, a heater for heating the polishing tool may be provided in a polishing table having the polishing tool thereon. As a further alternative, a sliding contact member may be brought into sliding contact with the polishing tool to heat the polishing tool by frictional heat or the like.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

Figure 1:
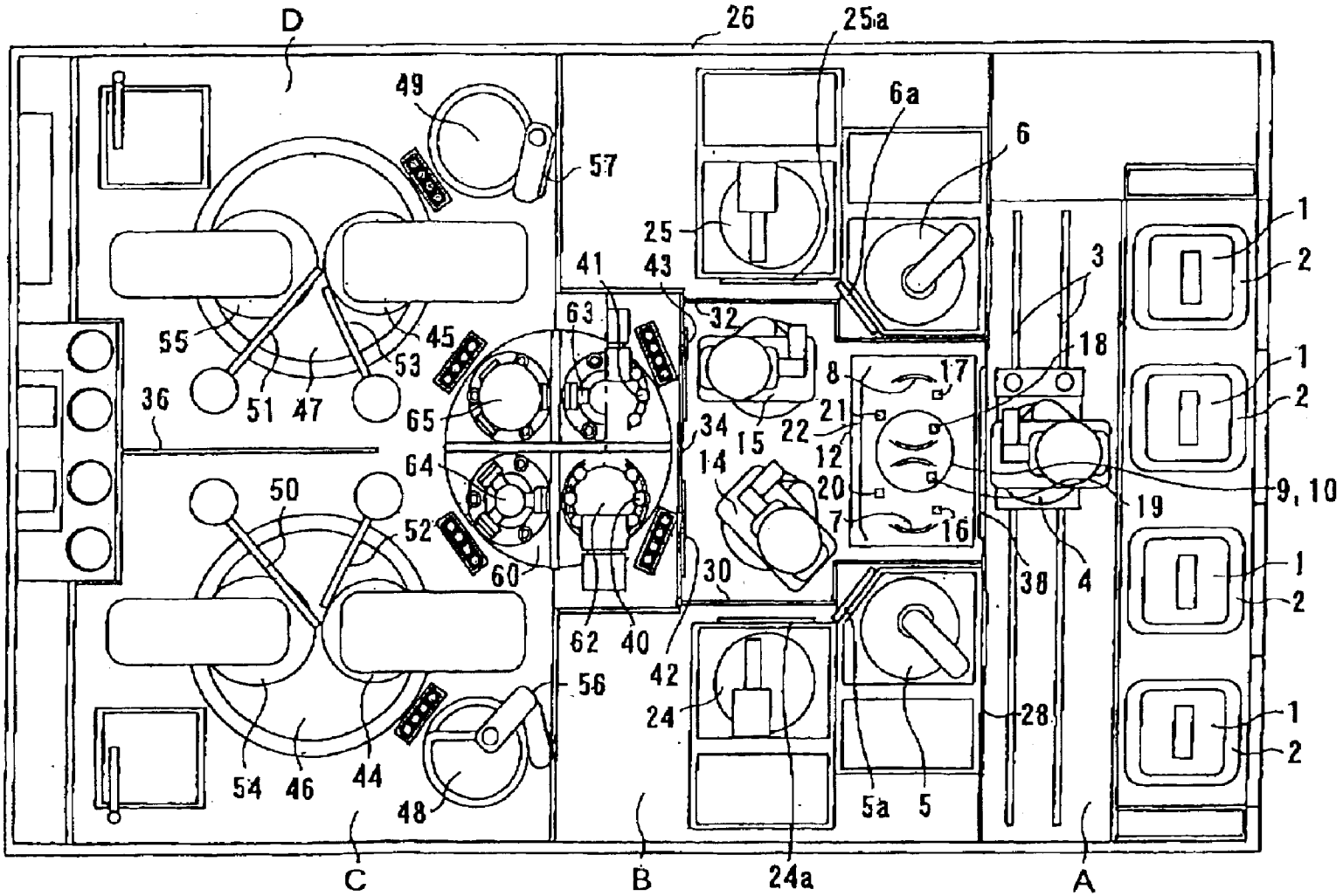
FIG. 1 is a plan view showing an entire arrangement of a polishing apparatus according to an embodiment of the present invention.

A polishing tool and a polishing apparatus incorporating the polishing tool according to embodiments of the present invention will be described below.

A polishing tool according to the present invention is incorporated in a polishing apparatus, and serves to accurately polish a workpiece such as a semiconductor wafer in a state such that the workpiece is pressed against and brought into sliding contact with the polishing tool. The polishing tool according to the present invention may comprise a fixed abrasive having abrasive particles contained in a resin, or a polishing pad having no abrasive particles therein.

First, a polishing tool according to the present invention will be described below in view of the composition of resin contained therein. The polishing tool according to the present invention is mainly composed of thermoplastic resin. Specifically, the polishing tool is composed of a resin containing thermoplastic resin content of 50% or more, preferably 80% or more, and more preferably 90% or more. The polishing tool is mainly composed of thermoplastic resin as described above, and the rest of the resin may contain thermosetting resin. The thermoplastic resin should preferably comprise linear macromolecules. Linear macromolecules are bonded by merely entangling their main chains with each other. When linear macromolecules are used in a resin to form a fixed abrasive of a polishing tool in which abrasive particles are fixed in the resin, a polishing surface on the fixed abrasive becomes likely to be regenerated during polishing. Thus, linear macromolecules are suitable for use in a resin of a polishing tool.

In the case of resin having a large number of three-dimensional bridges, it is necessary to break their chemical bonds in order to expose a new surface (a surface having not been deteriorated) which has unused abrasive particles therein. On the other hand, in the case of a linear polymer (linear macromolecules) which has substantially no bridge structure, it is possible to effectively expose a new surface by simply decoupling intermolecular forces, which have lower energy than chemical bonds. Thus, linear macromolecules are suitable for use in a resin of a polishing tool.

The thermoplastic resin should preferably have an average glass transition temperature ranging from 270 K to 400 K. When a resin in a polishing tool is heated by polishing, the temperature of thermoplastic resin is increased to a temperature higher than an average glass transition temperature thereof. As a result, the polishing tool becomes more flexible. In this case, a workpiece can be polished with a soft polishing surface on the polishing tool, and hence scratches are prevented from being produced on a surface of the workpiece.

The thermoplastic resin in the polishing tool should preferably comprise a phase having a high glass transition temperature and a phase having a low glass transition temperature, and have an average glass transition temperature within the above range as a whole. The thermoplastic resin should preferably contain a phase having a low glass transition temperature (Tg) of 320 K or lower within a range of from 10 weight % to 90 weight %, and a phase having a high glass transition temperature (Tg) of 320 K or higher within a range of from 90 weight % to 10 weight %. More preferably, the thermoplastic resin should contain a phase having a low glass transition temperature (Tg) 310 K or lower within a range of from 20 weight % to 80 weight %, and a phase having a high glass transition temperature (Tg) of 330 K or higher within a range of from 80 weight % to 20 weight %. More preferably, the thermoplastic resin should contain a phase having a low glass transition temperature (Tg) of 300 K or lower within a range of from 20 weight % to 80 weight %, and a phase having a high glass transition temperature (Tg) of 340 K or higher within a range of from 80 weight % to 20 weight %. In a case where the phase having a high glass transition temperature (Tg) or the phase having a low glass transition temperature (Tg) contains a plurality of kinds of monomers, the high glass transition temperature (Tg) or the low glass transition temperature (Tg) means an average glass transition temperature of the phase, respectively. The ratio of materials for the thermoplastic resin can be adjusted so that the thermoplastic resin has an average glass transition temperature (Tg) ranging from 270 K (−3° C.) to 400 K (127° C.), preferably from 300 K to 380 K, and more preferably from 310 K to 360 K The ratio of materials for a linear polymer can be adjusted so that deterioration such as pyrolysis is not caused in a resin at temperatures ranging from 270 K to 400 K.

As described above, the thermoplastic resin comprises a phase having a high glass transition temperature and a phase having a low glass transition temperature. Such thermoplastic resin serves as a hard structural member at a location which is away from a polishing surface and which has an approximately ordinary temperature. At a location at which the temperature is increased by friction on the polishing surface, the temperature of the thermoplastic resin becomes higher than a glass transition temperature of the phase having a low glass transition temperature, and the thermoplastic resin gets resilient characteristics. Therefore, the polishing tool has an excellent capability of absorbing impact near the polishing surface, so that scratches are prevented from being produced on a semiconductor wafer. Further, a phase having a high glass transition temperature can prevent the polishing tool from becoming so soft as to lower a polishing rate. Therefore, the polishing tool thus constructed can simultaneously achieve effective polishing and prevent scratching, which may seem to be inconsistent with each other.

In a polishing tool according to the present invention, the weight average molecular weight of linear macromolecules contained in the polishing tool should preferably be within a range of from 5,000 to 5,000,000, and more preferably from 10,000 to 3,000,000. When the molecular weight of linear macromolecules is smaller, i.e., main chains of linear macromolecules are shorter, linear macromolecules are entangled with each other at fewer points, and bonding strengths are smaller. Therefore, formed resin (resin formed of linear macromolecules) may have a surface which is likely to collapse.

When an external force is applied to the resin formed as a polishing tool during polishing, the uppermost portion of the polishing surface is removed, and a new surface (a surface having not been deteriorated) is exposed as a lower phase. When the polishing tool comprises a fixed abrasive, abrasive particles are loosened on the surface of the resin, and new abrasive particles that have been contained within the resin appear on the uppermost surface. Specifically, the number of abrasive particles contributing to polishing is increased to achieve highly efficient polishing.

When the molecular weight of the linear macromolecules is larger (e.g., larger than 5,000,000), i.e., main chains of linear macromolecules are longer, bonding strengths are large in the uppermost portion of the polishing surface on the polishing tool. Therefore, the polishing tool contains therein an increased number of abrasive particles deteriorated by polishing, so that the efficiency of polishing is adversely lowered. On the other hand, if the molecular weight of the linear macromolecules is considerably small, then the polishing tool loses characteristics of macromolecules and effectiveness for processing. Therefore, the linear macromolecules should have a minimum molecular weight to a certain extent, for example, 5,000 or higher. Thus, the molecular weight of linear macromolecules should preferably be within a range of from 5,000 to 5,000,000, and more preferably from 10,000 to 3,000,000.

The thermoplastic resin may comprise additional polymerization resin, polycondensation resin, polyaddition resin, or ringopening polymerization resin. The additional polymerization resin includes resin based on vinyl type monomers, such as polyethylene type resin, polypropylene type resin, polybutadiene type resin, polyvinyl chloride type resin, polystyrene type resin, polyvinylidene chloride type resin, fluorine type resin, and acrylic type resin. The polycondensation resin includes polyamide type resin, polyester type resin, polycarbonate type resin, and polyphenylene oxide type resin. The polyaddition resin includes thermoplastic polyurethane type resin. The ringopening polymerization resin includes polyacetal type resin. As long as the aforementioned conditions are satisfied, two or more resins selected from the above may be mixed with each other, or copolymerization may be performed on monomers of the above resins to form thermoplastic resin.

From a viewpoint of glass transition temperatures and easiness of adjusting the molecular weight, it is desirable to use a thermoplastic resin based on vinyl type monomers. Particularly, it is desirable to use linear macromolecules which contain aromatic vinyl type monomers in a range of from 0 weight % to 80 weight %, acrylic ester type monomers (methacrylic acid ester type monomers) in a range of from 0 weight % to 100 weight %, and vinyl type monomers which can be copolymerized with the aromatic vinyl type monomers and the acrylic ester type monomers (methacrylic acid ester type monomers), in a range of from 0 weight % to 50 weight %, and which have a weight average molecular weight ranging from 5,000 to 5,000,000. More particularly, it is desirable to use linear macromolecules which contain aromatic vinyl type monomers in a range of from 10 weight % to 60 weight %, acrylic ester type monomers (methacrylic acid ester type monomers) in a range of from 40 weight % to 100 weight %, and vinyl type monomers which can be copolymerized with the aromatic vinyl type monomers and the acrylic ester type monomers (methacrylic acid ester type monomers) in a range of from 0 weight % to 50 weight %, and which have a weight average molecular weight ranging from 5,000 to 5,000,000, preferably from 10,000 to 3,000,000. Here, a polystyrene equivalent value which is measured by gel permeation chromatography with use of standard polystyrene is used as a weight average molecular weight.

The aromatic vinyl type monomers include, for example, styrene, α-methylstyrene, o-methylstyrene, p-methylstyrene, t-butylstyrene, vinyltoluene, methyl-α-methylstyrene, divinylbenzene, 1,1-diphenylstyrene, vinylxylene, N,N-diethyl-p-aminoethylstyrene, N,N-diethyl-p-aminomethylstyrene, vinylpyridine, and vinylnaphthalene. Preferably, the aromatic vinyl type monomers comprise styrene.

The acrylic ester type monomers (methacrylic acid ester type monomers) include (1) acrylic alkyl ester, such as methyl acrylate, ethyl acrylate, propyl acrylate, butyl acrylate, hexyl acrylate, octyl acrylate, 2-ethylhexyl acrylate, cyclohexyl acrylate, and phenyl acrylate, glycidyl acrylate, and hydroxylethyl acrylate, and (2) methacrylic acid alkyl ester, such as methyl methacrylate, ethyl methacrylate, propyl methacrylate, butyl methacrylate, hexyl methacrylate, octyl methacrylate, 2-ethylhexyl methacrylate, cyclohexyl methacrylate, dodecyl methacrylate, octadecyl methacrylate, phenyl methacrylate, and benzyl methacrylate, glycidyl methacrylate, and hydroxylethyl methacrylate. Preferably, the acrylic ester monomers (methacrylic acid ester monomers) comprise butyl acryl ate, methyl methacryl ate, or butyl methacrylate.

The vinyl type monomers which can be copolymerized with the above monomers include acrylonitrile (AN), methacrylonitrile, butadiene, isoprene, ethylene, propylene, vinyl chloride, vinylidene chloride, acrylic acid, and methacrylic acid. Polyfunctional monomers, such as allyl methacrylate, 1,3-butanediol, or divinylbenzene, may be used as needed. For linear macromolecules having proper weight average molecular weight, vinyl type monomers which can be copolymerized with the above monomers should not be added or should be added only in a small amount.

The thermoplastic resin can be produced by any known polymerization method. For example, the thermoplastic resin may be produced by block polymerization, suspension polymerization, emulsion polymerization or solution polymerization. Polymers produced by the above methods may be mixed with each other. Any polymerization initiator or any molecular weight adjustor can be used in the above polymerization methods. Any dispersing agent or any emulsifying agent may be used in suspension polymerization or emulsion polymerization.

In order to prevent impurities from being produced, emulsion polymerization may be performed without an emulsifying agent. A method of producing thermoplastic resin having a plurality of phases is not limited to a specific one. For example, a plurality of resins produced in advance may be mixed by a known method, or polymerization may controllably be performed so that thermoplastic resin has a plurality of phases. Structures or units of phases vary depending on a method to be performed. The thermoplastic resin may have a macro phase structure having a unit of several micrometers or larger, a micro phase structure having a unit of from tens of nanometers to several micrometers, or a structure having a unit of tens of nanometers or smaller (e.g., blockcopolymer). Preferably, the thermoplastic resin has a structure having a unit of tens of nanometers or smaller. More preferably, the thermoplastic resin has a structure having a unit substantially equal to or smaller than an average particle diameter of an abrasive particle to be used.

Next, a polishing tool according to the present invention will be described below in view of the above-described characteristics.

When a polishing tool is used for polishing a semiconductor wafer, a polishing tool made of thermoplastic resin having a glass transition temperature (Tg) lower than a polishing temperature obtains a rubber-like form. Specifically, flexibility and capability of absorbing impact can be increased to prevent scratches from being produced when a semiconductor wafer is polished. However, resin having a glass transition temperature (Tg) lower than an ordinary atmospheric temperature (25° C.) has rubber-like characteristics and is soft at the ordinary temperature. Although such resin can prevent scratches from being produced, it is unlikely to have an excellent capability of planarization, which is one of the features of a fixed abrasive, and does not have good durability as a tool. Therefore, a polishing tool according to the present invention utilizes resin comprising a phase having a high glass transition temperature (Tg) and a phase having a low glass transition temperature (Tg). Since such a polishing tool has an average glass transition temperature (Tg) of near an ordinary (room) temperature, the polishing tool has rubber-like characteristics through temperature increase due to polishing, and achieves advantageous effects of preventing scratches when a polishing surface is microscopically seen. Simultaneously, the polishing pad has such a low cohesiveness as to be easily handled, which is one of the features of resin having a high glass transition temperature (Tg). Thus, an excellent capability of planarization can be easily produced.

For polishing a semiconductor wafer having device patterns formed thereon, the semiconductor wafer is pressed and brought into sliding contact with a polishing tool according to the present invention. A polishing tool utilizing thermoplastic linear macromolecules as described above can polish a semiconductor wafer with an extremely reduced number of scratches, and thus has excellent polishing properties for polishing a semiconductor wafer. Simultaneously, such a polishing tool can easily be produced. Thermosetting resin such as polyvinyl alcohol (PVA), phenolic resin, or epoxy resin has heretofore been used widely in a conventional polishing tool for polishing a workpiece such as a semiconductor wafer. According to the present invention, thermoplastic resin is used instead of thermosetting resin, and particularly, a polishing tool utilizes resin having an average glass transition temperature ranging from 270 K to 400 K. A polishing tool according to the present invention has good performance as compared to the conventional polishing tool. A polishing tool may be embodied as a fixed abrasive having abrasive particles therein or a polishing pad having no abrasive particles therein.

As described above, a fixed abrasive as a polishing tool has abrasive particles therein. Materials for abrasive particles may comprise cerium oxide ($CeO_2$), alumina ($Al_2O_3$), silicon carbide (SiC), silicon oxide ($SiO_2$), zirconia ($ZrO_2$), iron oxide (FeO, $Fe_3O_4$), manganese oxide ($MnO_2$, $Mn_2O_3$), magnesium oxide (MgO), calcium oxide (CaO), barium oxide (BaO), zinc oxide (ZnO), barium carbonate ($BaCO_3$), calcium carbonate ($CaCO_3$), diamond (C), titanium oxide ($TiO_2$), or combination thereof. The materials for abrasive particles may be in the form of a powder or a slurry. However, in order to produce a uniform fixed abrasive, it is preferable to use slurry-like abrasive particles, which stably contain fine abrasive particles. More preferably, the polishing tool should contain abrasive particles having a particle diameter of from 10 nm to 10 $\mu$m. Further, in order to produce a polishing tool for processing semiconductor wafers, any metals contained in materials for abrasive particles should be minimized.

A fixed abrasive comprises abrasive particles, a binder, and pores. The binder mainly comprises thermoplastic resin according to the present invention. For example, a composition ratio of a fixed abrasive, which is a ratio of volume percentages (vol %) of abrasive particles (Vg), a binder (Vb), and pores (Vp), may be expressed as follows:

Abrasive particles (Vg): a binder (Vb): pores (Vp)= 35:55:10 (vol %)

Generally, the composition ratio can be selected so as to meet the following relationships 10%<percentage of abrasive particles (Vg)<50%

30%<percentage of a binder (Vb)<80%

0%<percentage of pores (Vp)<40%

Preferably, the composition ratio should be selected so as to meet the following relationships.

20%<percentage of abrasive particles (Vg)<45%,

40%<percentage of a binder (Vb)<70%

0%<percentage of pores (Vp)<20%

More preferably, the composition ratio should be selected so as to meet the following relationships.

30%<percentage of abrasive particles (Vg)<40%

50%<percentage of a binder (Vb)<60%

5%<percentage of pores (Vp)<15%

Next, an example of a polishing tool according to the present invention will be described below. Styrene (St) was used as an aromatic vinyl monomer, and methyl methacrylate (MMA), butyl acrylate (BA), and butyl methacrylate (BMA) were used as acrylic ester monomers (methacrylic acid ester monomers). A mixed ratio of monomers was expressed as follows:

St:MMA:BA:BMA=34:33:29:4 (by weight)

Polymers produced from the respective monomers have glass transition temperatures (Tg) listed below in Table 1.

TABLE 1

| Abbreviation | Name | Tg |
|---|---|---|
| St | Styrene | 373 K (100° C.) |
| MMA | methyl methacrylate | 378 K (105° C.) |
| BA | butyl acrylate | 219 K (−54° C.) |
| BMA | butyl methacrylate | 293 K (20° C.) |

Emulsion polymerization was performed on a mixture of the above monomers, and produced polymers were separated. An average glass transition temperature (Tg-ave) can be calculated by Fox formula expressed as follows:

$$Tg\,[K]=100/\Sigma(i)\{W(i)/Tg(i)\}[K]$$

where W(i) represents the weight percentage of polymers (i), and Tg(i) represents the glass transition temperature Tg [K] of polymers (i). An average glass transition temperature of the polymers can be calculated by Fox formula in the following manner.

$$\begin{aligned} Tg[K] &= 100/\sum(i)\{W(i)/Tg(i)\}[K] \\ &= 100/(34/373+29/219+33/378+4/293)[K] \\ &= 100/(0.32452637)[K] \\ &= 308[K] \\ &= 35[^{\circ}C.] \end{aligned}$$

Thus, in the case of a mixed ratio of materials as described above, an average glass transition temperature (Tg-ave) is 308 K (35° C.). Specifically, this average glass transition temperature (Tg-ave) is within the following range.

$$270\text{ K }(-3^{\circ}\text{ C.})<Tg\text{-}ave<400\text{ K }(127^{\circ}\text{ C.})$$

Thus, the average glass transition temperature (Tg-ave) of the polymer satisfies the conditions described above.

In another example, styrene (St) was used as an aromatic vinyl monomer, and methyl methacrylate (MMA), butyl acrylate (BA), and butyl methacrylate (BMA) were used as acrylic ester monomers (methacrylic acid ester monomers), with the following mixed ratio.

St:MMA:BA:BMA=18:3:29:0 (by weight)

A proper amount of n-octyl mercaptan was added as a molecular weight adjustor to a mixture of the above monomers, and seed particles were polymerized. A mixture of monomers for dropping was prepared with a mixed ratio of St:MMA:BA:BMA=16:30:0:4 (by weight). A proper amount of n-octyl mercaptan was added as a molecular weight adjustor to the mixture for dropping. The mixture for dropping was dropped into the mixture having the seed particles and polymerized. The seed particles consisted of a phase having low glass transition temperature (Tg=265 K) of 50 weight %, and polymers produced from the mixture of monomers for dropping consisted of a phase having a high glass transition temperature (Tg=368 K). Thus, multiphase polymers having an average glass transition temperature of 308 K as a whole were obtained. The multiphase polymers comprised linear macromolecules having substantially no bridge structure, and the polymers had a weight average molecular weight of 100,000.

Next, polishing performance when a fixed abrasive produced from the above polymers is used as a polishing tool will be described below.

In an experiment, a fixed abrasive produced from the above polymers could achieve a polishing rate of about 2000 Å/min and had an excellent capability of planarization and a high level of uniformity. For one semiconductor wafer, scratches were produced at 215 points. Thus, the fixed abrasive had good performance as compared to a conventional chemical mechanical polishing (CMP) process in which a standard polishing pad (IC1000/SUBA400) and a standard polishing liquid (SS-25) are combined.

Next, a method of producing the polishing tool described above will briefly be described below.

Thermoplastic resin (polymer) is produced by polymerizing monomers. At this time, various types of chemical liquids and water typified by organometallic compounds and inorganometallic compounds, such as a polymerization catalyst, an emulsifying agent, a polymerization inhibitor, a dispersing agent, an activator, a solvent, a catalyst inactivator, a stabilizer, or an antioxidant, are used through complicated processes to produce a high polymer. In order to reduce the amount of metal elements mixed into materials for a high polymer of a polishing tool, the amount of metal compounds contained in the chemical liquid and water used in various polymerization processes should preferably be minimized. Pure water, ultra pure water, or a solvent with high purity should preferably be used as water or solvent.

Materials for a polymer may be in the form of powder or emulsion. However, it is preferable to use a latex suspension liquid which contains abrasive particles dispersed uniformly in a liquid in order to make the composition ratio of granulated particles as an intermediate product uniform, and in order to improve the uniformity of dispersing abrasive particles in a fixed abrasive. Moreover, any metals contained in materials for a polymer should be minimized for processing semiconductor wafers, i.e., for polishing semiconductor wafers with less metal contamination.

The polymer may be produced by various types of emulsion polymerization. For example, seed polymerization has been known as a method of producing such a polymer. Now, the seed polymerization will be described below First, monomers or a mixture of monomers is separated into monomers for initial addition and monomers for dropping. Then, a pH buffer such as boric acid or sodium carbonate is added to a water solvent. The water solvent is heated at temperatures in a range of from 70° C. to 85° C. A persulfate polymerization initiator, such as potassium persulfate, is added to the water solvent while the water solvent is agitated under an inert atmosphere. Thereafter, the monomers for initial addition are added one at a time, and the liquid is maintained for a certain period of time to form seed particles. Subsequently, monomers for dropping are dropped into this polymerization liquid for a certain period of time immediately after the persulfate polymerization initiator is added to the liquid. The liquid is maintained for a certain period of time. A multiphase polymer having different glass transition temperatures can be produced by adjusting the composition of monomers for initial addition and monomers for dropping.

A mixed liquid in which various kinds of materials are mixed with each other at a certain ratio is prepared and then dried to produce a mixed powder. A drying process may comprise air drying, drying by heating, or freeze drying. It is desirable to utilize a spray drier. The mixed powder thus produced is compressed and molded in a mold under proper conditions of temperature to form a polishing tool having a desired shape. Instead of drying, aggregation and/or precipitation may be utilized to produce a mixed powder. When the powder (mixed powder) is produced, a drying process after mixing and/or a mixing process after drying may be repeated as needed. Dried powders of a plurality of materials may be directly mixed with each other in accordance with materials to be mixed. In order to reduce the amount of metal or other impurities mixed, the mixture may be cleaned with water or organic solvent during the above processes.

In the case where a fixed abrasive element of a polishing tool is produced, materials for abrasive particles may be dispersed uniformly when resin is polymerized. In order to improve the uniformity of dispersing abrasive particles, it is desirable to use a suspension in which abrasive particles are dispersed in a liquid. The suspension is dried to form a mixed powder, and the mixed powder is compressed and molded to produce a fixed abrasive of a polishing tool.

Examples of a polishing apparatus according to the present invention will be described below with reference to FIGS. 1 and 2. FIG. 1 is a plan view showing an entire arrangement of a polishing apparatus according to an embodiment of the present invention.

As shown in FIG. 1, the polishing apparatus comprises four load/unload stages 2 each for receiving a wafer cassette 1 which accommodates a plurality of workpieces such as semiconductor wafers. Each of the load/unload stages 2 may have a mechanism for lifting and lowering the wafer cassette 1. The polishing apparatus has a transfer robot 4 provided on rails 3 so that the transfer robot 4 can move along the rails 3 to access respective wafer cassettes 1 at respective load/unload stages 2.

The transfer robot 4 has upper and lower hands. The lower hand of the transfer robot 4 is a vacuum attraction-type hand for holding a semiconductor wafer under vacuum, and used only for removing a wafer from a wafer cassette 1. The vacuum attraction-type hand can hold and transport the semiconductor wafer even if the semiconductor wafer is not located at a normal position in the wafer cassette due to a slight displacement. The upper hand of the transfer robot 4 is a recess support-type hand for supporting a peripheral edge of a semiconductor wafer via a recess formed in the hand, and used only for returning the wafer to the wafer cassette 1. The recess support-type hand can transport the semiconductor wafer while keeping the semiconductor wafer clean because dust is not collected, unlike the vacuum attraction-type hand. In this manner, since a clean semiconductor wafer which has been cleaned is held by the upper hand, the clean semiconductor wafer is not further contaminated.

The polishing apparatus has two cleaning units 5, 6 disposed at an opposite side of the load/unload stages 2 with respect to the rails 3 of the transfer robot 4. These cleaning units 5, 6 are used for cleaning a semiconductor wafer. The cleaning units 5, 6 are disposed at positions accessible by the hands of the transfer robot 4. Each of the cleaning units 5, 6 has a spin-dry mechanism for drying a wafer by spinning the wafer at a high speed, and hence two-stage cleaning and three-stage cleaning of a wafer can be performed without replacing any cleaning modules.

Between the two cleaning units 5 and 6, a wafer station 12 having four wafer supports 7, 8, 9 and 10 is disposed at a position accessible by the transfer robot 4. A transfer robot 14 having two hands is disposed at a position where hands of the transfer robot 14 can access the cleaning unit 5 and the three wafer supports 7, 9 and 10. A transfer robot 15 having two hands is disposed at a position where hands of the transfer robot 15 can access the cleaning unit 6 and the three wafer supports 8, 9 and 10.

The wafer support 7 is used to transfer a wafer between the transfer robot 4 and the transfer robot 14 and has a sensor 16 for detecting existence of a wafer. The wafer support 8 is used to transfer a wafer between the transfer robot 4 and the transfer robot 15 and has a sensor 17 for detecting existence of a wafer.

The wafer support 9 is used to transfer a wafer from the transfer robot 15 to the transfer robot 14, and has a sensor 18 for detecting existence of a wafer and a rinsing nozzle 20 for supplying a rinsing liquid to the wafer to prevent the wafer from being dried or to rinse the wafer. The wafer support 10 is used to transfer a wafer from the transfer robot 14 to the transfer robot 15, and has a sensor 19 for detecting existence of a wafer and a rinsing nozzle 21 for supplying a rinsing liquid to the wafer to prevent the wafer from being dried or to rinse the wafer.

The wafer supports 9 and 10 are disposed in a common water-scatter-prevention cover which has an opening defined therein for transferring wafers therethrough. The opening can be opened and closed by a shutter 22. The wafer support 9 is disposed above the wafer support 10. Upper wafer support 9 serves to support a wafer which has been cleaned, and lower wafer support 10 serves to support a wafer to be cleaned, so that the cleaned wafer is prevented from being contaminated by rinsing liquid which would otherwise fall thereon. The sensors 16, 17, 18 and 19, the rinsing nozzles 20, 21, and the shutter 22 are schematically shown in FIG. 1, and their positions and shapes are not exactly illustrated.

A cleaning unit 24 is disposed at a position adjacent to the cleaning unit 5 and is accessible by the hands of the transfer robot 14, and another cleaning unit 25 is disposed at a position adjacent to the cleaning unit 6 and is accessible by hands of the transfer robot 15. Each of the cleaning units 24 and 25 is capable of cleaning both surfaces of a wafer.

The transfer robot 14 and the transfer robot 15 have respective two hands which are located in a vertically spaced relationship. The respective upper hands of the transfer robot 14 and the transfer robot 15 are used for transporting a semiconductor wafer that has been cleaned to the cleaning units or the wafer supports of the wafer station 12. The respective lower hands of the transfer robot 14 and the transfer robot 15 are used for transporting a semiconductor wafer that has not cleaned or a semiconductor wafer to be polished. Since the lower hands are used to transfer a wafer to or from a reversing device, the upper hands are not contaminated by drops of rinsing liquid which fall from an upper wall of the reversing device.

As shown in FIG. 1, the cleaning units 5, 6, 24 and 25 have shutters 5*a*, 6*a*, 24*a* and 25*a* for transferring wafers therethrough, respectively. The shutters 5*a*, 6*a*, 24*a* and 25*a* are opened only when wafers are transferred through the shutters 5*a*, 6*a*, 24*a* and 25*a*.

The polishing apparatus has a housing 26 for enclosing various components therein. An interior of the housing 26 is partitioned into a plurality of compartments or sections (including areas A and B) by partition walls 28, 30, 32, 34 and 36.

Area A in which the load/unload stages 2 and the transfer robot 4 are disposed, and area B in which the cleaning units 5 and 6 and the wafer supports 7, 8, 9 and 10 are disposed, are partitioned by the partition wall 28 so that cleanliness of area A and area B can be separated from each other. The partition wall 28 has an opening for allowing semiconductor wafers to pass therethrough, and a shutter 38 is provided at the opening of the partition wall 28. All of the cleaning units 5, 6, 24 and 25, the wafer supports 7, 8, 9 and 10 of the wafer station 12, and the transfer robots 14 and 15 are placed in area B. Pressure in area B is adjusted so as to be lower than pressure in area A.

As shown in FIG. 1, in area C separated from area B by the partition wall 34, a reversing device 40 for reversing a semiconductor wafer is provided at a position accessible by the hands of the transfer robot 14. The semiconductor wafer is transferred to the reversing device 40 by the transfer robot 14. Further, in area C, a reversing device 41 for reversing a semiconductor wafer is provided at a position accessible by the hands of the transfer robot 15. The semiconductor wafer is transferred to the reversing device 41 by the transfer robot 15. Each of the reversing devices 40 and 41 has a chuck mechanism for chucking a semiconductor wafer, a reversing mechanism for reversing the semiconductor wafer, and a wafer detecting sensor for detecting whether or not the chuck mechanism chucks the semiconductor wafer.

The partition wall 34 forms a polishing section which is separated from area B. The polishing section is further divided into two areas C and D by the partition wall 36. The partition wall 34 between area B and areas C, D has two openings each for allowing semiconductor wafers to pass therethrough, one of which openings is used for transferring a wafer W to or from the reversing device 40 and the other of which openings is used for transferring a wafer to or from the reversing device 41. Shutters 42, 43 are respectively provided at the openings of the partition wall 34.

As shown in FIG. 1, each of areas C and D has two polishing tables and one top ring (holding device) for holding and pressing one semiconductor wafer against the polishing tables to polish the wafer. Specifically, area C has a top ring 44, a polishing table 46 having a large diameter, a polishing table 48 having a small diameter, a polishing liquid supply nozzle 50 for supplying a polishing liquid onto the polishing table 46, an atomizer 52 having a plurality of ejection nozzles (not shown) connected to a nitrogen gas supply source and a liquid supply source, a dresser 54 for dressing the polishing table 46, and a dresser 56 for dressing the polishing table 48. The diameter of the polishing surface of the large-diameter polishing table 46 is not less than twice the diameter of the semiconductor wafer. The diameter of the polishing surface of the small-diameter polishing table 48 is larger than the diameter of the semiconductor wafer, and is smaller than twice the diameter of the semiconductor wafer. Similarly, area D has a top ring 45, a polishing table 47 having a large diameter, a polishing table 49 having a small diameter, a polishing liquid supply nozzle 51 for supplying a polishing liquid onto the polishing table 47, an atomizer 53 having a plurality of ejection nozzles (not shown) connected to a nitrogen gas supply source and a liquid supply source, a dresser 55 for dressing the polishing table 47, and a dresser 57 for dressing the polishing table 49.

The polishing liquid supply nozzles 50, 51 supply polishing liquids, used for a polishing process, and dressing liquids (e.g., water) used for a dressing process, onto the polishing tables 46, 47, respectively. The atomizers 52, 53 eject liquids composed of a mixture of nitrogen gas with pure water or chemical liquid onto the polishing tables 46, 47, respectively. Nitrogen gas from the nitrogen gas supply source and pure water or chemical liquid from the liquid supply source are passed through a regulator or air operated valve (not shown) to regulate pressure thereof to a predetermined value, and supplied to the ejection nozzles in the atomizers 52, 53 in a mixed state. The chemical liquid may comprise a surface-active agent, preferably an anionic surface-active agent. In this case, the liquid should preferably be ejected from the ejection nozzles of the atomizers 52, 53 toward outer peripheral edges of the polishing tables 46, 47. Other inert gases may be used instead of nitrogen gas. Further, the atomizers 52, 53 may eject only a liquid of pure water or chemical liquid. The polishing tables 48, 49 may have atomizers as with the polishing tables 46, 47, respectively. With atomizers for the polishing tables 48, 49, surfaces of the polishing tables 48, 49 can be kept clean.

The mixture of nitrogen gas with pure water or chemical liquid is supplied in a state of (1) liquid fine particles, (2) solid fine particles as a result of solidification of the liquid, or (3) gas as a result of vaporization of the liquid. These states (1), (2) and (3) are referred to as atomization. In these states, the mixture is ejected from the ejection nozzles of the atomizers 52, 53 toward the polishing tables 46, 47. For example, pressure or temperature of the nitrogen gas and/or the pure water or the chemical liquid, or the shape of the nozzles determines which state of the mixed liquid is to be ejected, i.e., the liquid fine particles, the solid fine particles, or gas. Therefore, the state of the liquid to be ejected can be varied, for example, by properly adjusting pressure or temperature of the nitrogen gas and/or the pure water or the chemical liquid with use of a regulator or the like, or by properly adjusting the shape of the nozzles.

The polishing tables 48, 49 may be replaced with wet-type thickness measuring devices for measuring a thickness of a film formed on a wafer. With such wet-type thickness measuring devices, the thickness of a film formed on a wafer can be measured immediately after the wafer is polished, and hence it is possible to further polish the polished wafer or to control a polishing process for polishing a subsequent wafer based on measured results.

Figure 2:
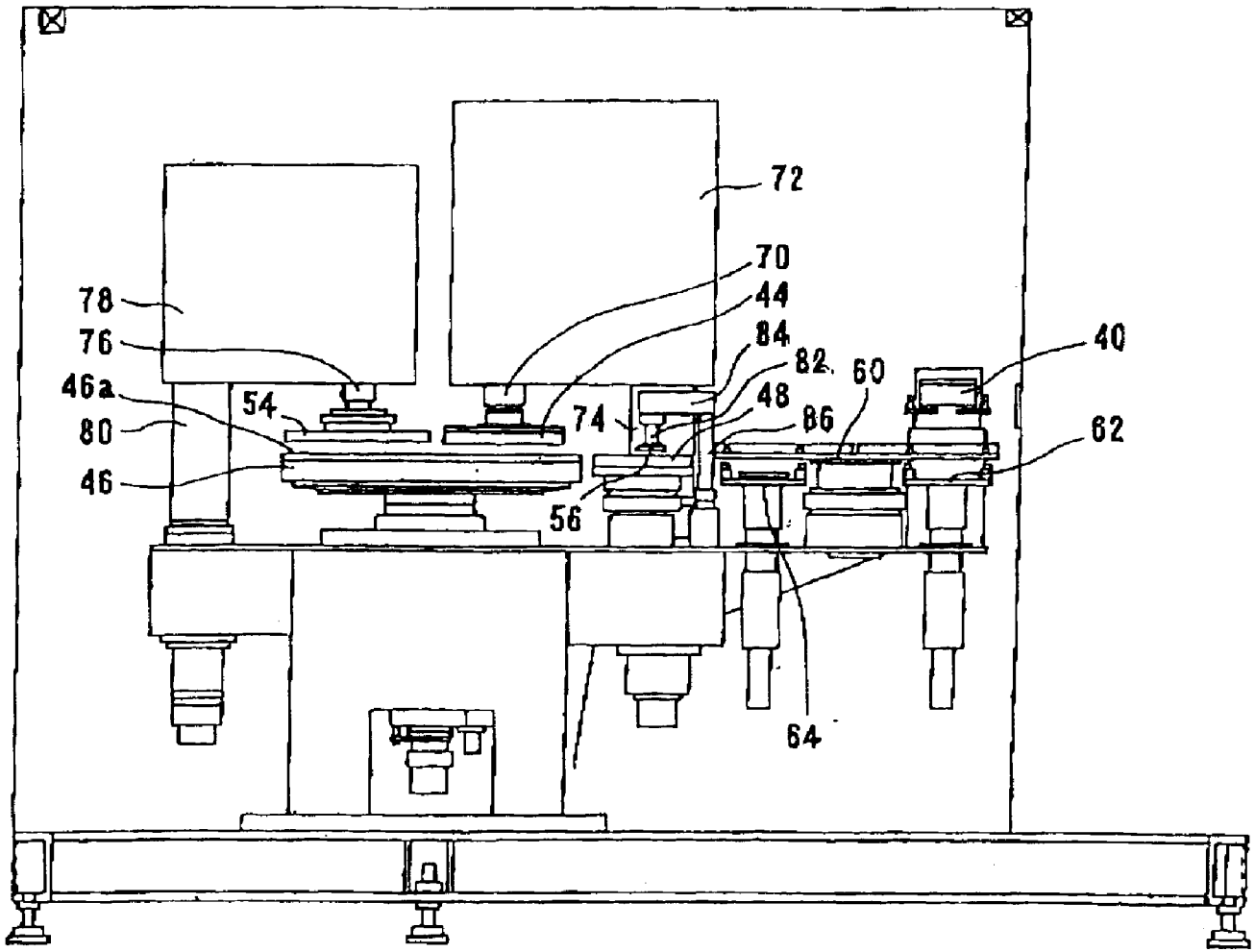
FIG. 2 is a front view of a polishing section in the polishing apparatus shown in FIG. 1.

As shown in FIGS. 1 and 2, a rotary transporter 60 is disposed below the reversing devices 40, 41 and the top ring 44 (in area C) and the top ring 45 (in area D). The rotary transporter 60 serves to transfer wafers between the cleaning section (area B) and the polishing section (areas C, D). The rotary transporter 60 has four stages for placing wafers W at equal angular intervals, and can hold a plurality of wafers thereon at the same time.

A wafer which has been transferred to the reversing device 40 or 41 is transferred to a lifter 62 or 63 disposed below the rotary transporter 60 by elevating the lifter 62 or 63 when a center of a stage of the rotary transporter 60 is aligned with a center of the wafer held by the reversing device 40 or 41. A wafer which has been transferred to the lifter 62 or 63 is transferred to the rotary transporter 60 by lowering the lifter 62 or 63. A wafer placed on the stage of the rotary transporter 60 is transported to a position below the top ring 44 (in area C) or the top ring 45 (in area D) by rotating the rotary transporter 60 by an angle of 90°. At this time, the top ring 44 (in area C) or the top ring 45 (in area D) is positioned above the rotary transporter 60 beforehand by a swinging motion of these top rings. A wafer held on the stage of the rotary transporter 60 is transferred to the top ring 44 or 45 by elevating a pusher 64 or 65 disposed below the rotary transporter 60 when a center of the top ring 44 or 45 is aligned with a center of the wafer.

Next, the polishing section (areas C, D) will be described below. Although only area C will be described below, the following description can be applied to area D. FIG. 2 shows a relationship between the top ring 44 and the polishing tables 46, 48 in area C.

As shown in FIG. 2, the top ring 44 is supported from a top ring head 72 by a top ring drive shaft 70 which is rotatable. The top ring head 72 is supported by a support shaft 74 which can angularly be positioned, and the top ring 44 can access the polishing tables 46 and 48.

The dresser 54 is supported from a dresser head 78 by a dresser drive shaft 76 which is rotatable. The dresser head 78 is supported by a support shaft 80 which can angularly be positioned, and the dresser 54 can be moved between a standby position and a dressing position above the polishing table 46. The dresser 56 is similarly supported from a dresser head 84 by a dresser drive shaft 82 which is rotatable. The dresser head 84 is supported by a support shaft 86 which can angularly be positioned, and the dresser 56 can be moved between a standby position and a dressing position above the polishing table 48. The dressers 54, 56 comprise diamond dressers having diamond particles electrodeposited thereon, respectively, for example.

The large-diameter polishing table 46 has an upper surface composed of a fixed abrasive 46*a* having abrasive particles and pores or a pore agent, which are fixed by a binder (resin). The upper surface of the fixed abrasive 46*a* serves as a polishing surface for polishing a semiconductor wafer held by the top ring 44. The fixed abrasive 46*a* is mainly composed of thermoplastic resin as described above. For example, a slurry-like polishing agent in which abrasive particles are dispersed in a liquid and an emulsion-like resin are mixed and dispersed with each other to form a mixed liquid. The mixed liquid is spray-dried to produce a mixed powder. The mixed powder is filled in a forming tool, and heated and pressurized therein to form a fixed abrasive 46*a*. The fixed abrasive 46*a* should preferably comprise abrasive particles of ceria ($CeO_2$) or silica ($SiO_2$) which have an average particle diameter of 0.5 $\mu$m or smaller. When a semiconductor wafer is polished, a polishing liquid having no abrasive particles (pure water or pure water with an addition agent is supplied onto the fixed abrasive 46*a*. Instead of the fixed abrasive 46*a*, the large-diameter polishing table 46 may have a polishing pad attached thereon which is mainly composed of thermoplastic resin.

The small-diameter polishing table 48 has an upper surface composed of a soft nonwoven fabric. The upper surface of the nonwoven fabric serves as a cleaning surface for cleaning a semiconductor wafer after a polishing process to remove abrasive particles attached to a surface of the wafer.

A semiconductor wafer polished with the fixed abrasive 46*a* is transferred to the small-diameter polishing table 48, in which a buff cleaning process is performed. Specifically, while the top ring 44 and the polishing table 48 are respectively rotated independently of each other, a polished semiconductor wafer held by the top ring 44 is pressed against the soft nonwoven fabric on the polishing table 48. At this time, a liquid containing no abrasive particles, such as pure water or alkali liquid, is supplied onto the nonwoven fabric from a cleaning liquid supply nozzle (not shown). The alkali liquid should preferably comprise an alkali liquid having a pH of 9 or larger, or an alkali liquid containing TMAH. With this buff cleaning process, abrasive particles attached to a surface of the polished semiconductor wafer can effectively be removed from the surface of the wafer.

Figure 3:
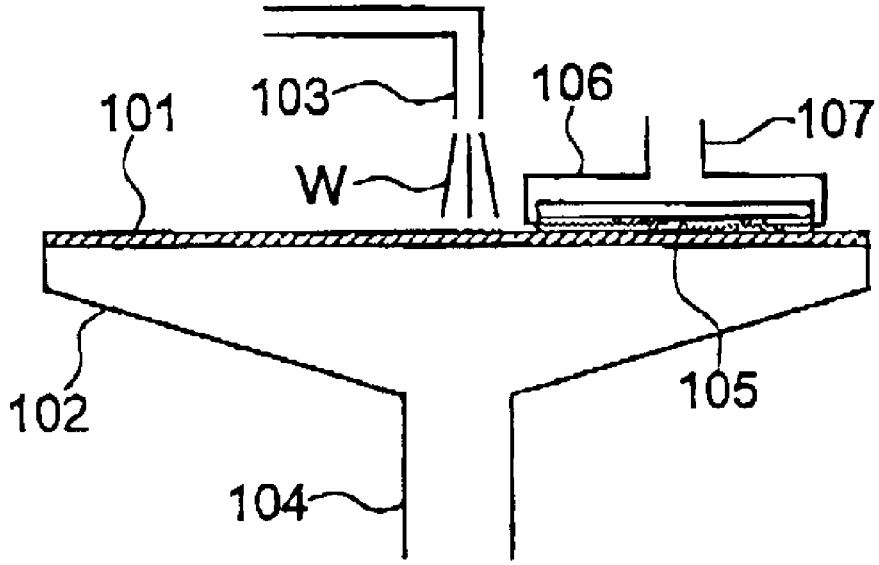
FIG. 3 is a schematic view showing a main portion of a polishing apparatus utilizing a fixed abrasive as a polishing tool according to an embodiment of the present invention.

Next, an example of use of a polishing tool according to the present invention will be described below with reference to FIGS. 3 and 4. FIG. 3 shows a main portion of a polishing apparatus utilizing a polishing tool of a fixed abrasive according to an embodiment of the present invention. The polishing apparatus shown in FIG. 3 comprises a polishing table 102 having a fixed abrasive 101 attached thereon, and a liquid supply nozzle 103 for supplying water or chemical liquid W having no abrasive particles therein during polishing. The fixed abrasive 101 is composed of thermoplastic resin of which average glass transition temperature is adjusted to be within a range of from 270 K to 400 K by mixing layers having different glass transition temperatures. The polishing apparatus has a top ring 106 for holding a workpiece 105 such as a semiconductor wafer so as to face the fixed abrasive 101. The workpiece 105 such as a semiconductor is rotated about a drive shaft 107 and is pressed via an elastic pad against the fixed abrasive 101 by the top ring 106. The polishing table 102 having the fixed abrasive 101 thereon is rotated about a drive shaft 104 independently of the workpiece 105. Thus, a polishing process is performed in a state such that a surface, to be polished, of the semiconductor wafer 105 is brought into sliding contact with a surface of the fixed abrasive 101.

Figure 4:
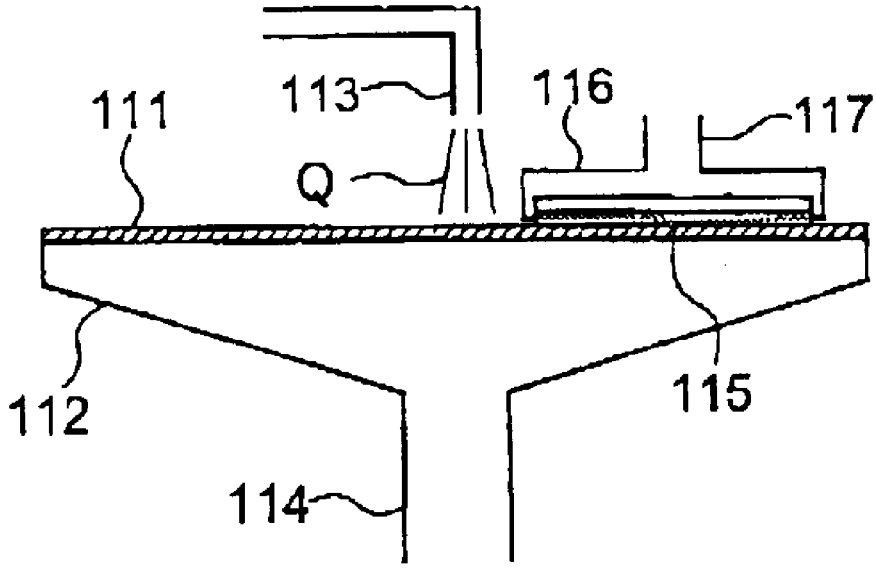
FIG. 4 is a schematic view showing a main portion of a polishing apparatus utilizing a polishing pad as a polishing tool according to an embodiment of the present invention.

FIG. 4 shows a main portion of a polishing apparatus utilizing a polishing liquid (slurry) and a polishing tool of a polishing pad according to an embodiment of the present invention. The polishing apparatus shown in FIG. 4 comprises a polishing table 112 having a polishing pad 111 attached thereon, and a top ring 116 for holding a workpiece 115 such as a semiconductor wafer so as to face the polishing pad 111. The polishing pad is composed of thermoplastic resin of which average glass transition temperature is adjusted to be within a range of from 270 K to 400 K. A slurry supply nozzle 113 supplies slurry Q containing a large amount of abrasive particles onto the polishing pad 111. Thus, a polishing process is performed in a state such that a surface, to be polished, of the semiconductor wafer 115 is brought into sliding contact with a surface of the polishing pad 111 onto which the slurry Q containing a large amount of abrasive particles is supplied.

As described above, the polishing tool of the fixed abrasive 101 or the polishing pad 111 is composed of thermoplastic resin of which average glass transition temperature is adjusted to be within a range of from 270 K to 400 K. Therefore, a surface of the polishing tool becomes flexible due to temperature increase during polishing, and it is possible to perform a soft polishing process in which scratches are not produced on a surface of a workpiece. Simultaneously, the polishing tool has solid characteristics as resin because an average glass transition temperature is set to be near temperatures of the polishing tool during polishing. Therefore, it is possible to perform a polishing process with an excellent capability of planarization and a high level of uniformity The polishing apparatus has a temperature controller for adjusting a temperature of an atmosphere near the polishing tool so as to be higher than a glass transition temperature of the polishing tool. With the temperature controller, a semiconductor wafer is polished in a state such that the temperature of the polishing tool is increased to be higher than its glass transition temperature and the polishing tool has rubber-like characteristics.

The temperature controller may comprise nozzle 103 or 113 for supplying heated chemical liquid or water W (i.e., heated fluid) onto the polishing tool 101 or 111. For example, when the glass transition temperature of thermoplastic resin in the polishing tool 101 or 111 is 35° C., the nozzle 103 or 113 as the temperature controller supplies chemical liquid or water W heated to a temperature ranging from about 70° C. to about 80° C. onto a polishing surface of the polishing tool 101 or 111, so that the temperature of the polishing surface can be increased to a temperature higher than the glass transition temperature of the polishing tool 101 or 111. In this case, water or chemical liquid W to be supplied onto the polishing tool 101 or 111 may be heated to a predetermined temperature by a heater provided at the upstream side of the nozzle 103 or 113. Alternatively, the semiconductor wafer to be polished may be heated to a temperature higher than the glass transition temperature of the polishing tool so that the temperature of the polishing tool becomes higher than the glass transition temperature of the polishing tool.

The temperature controller for heating the polishing tool 101 or 111 to a temperature higher than a glass transition temperature thereof may comprise an infrared lamp for heating the polishing tool 101 or 111, or a heater for supplying hot air onto the polishing tool 101 or 111. Alternatively, the temperature controller may comprise a heater provided in the polishing table 102 or 112 for heating the polishing tool 101 or 111 to a desired temperature. The temperature controller may comprise a sliding contact member which is brought into sliding contact with the polishing tool. The sliding contact member serves to heat the polishing tool by frictional heat or the like. Further, the temperature controller may comprise the aforementioned devices combined with each other.

The thermoplastic resin in the polishing tool 101 or 111 may be formed by mixture of various kinds of resin or polymerization. It is desirable that the thermoplastic resin has an average glass transition temperature higher than ordinary temperature (270K), and the temperature of the thermoplastic resin is increased to be higher than the average glass transition temperature.

In the above embodiments, the polishing apparatus has a rotatable polishing table. However, the polishing apparatus is not limited to a polishing apparatus having a rotatable polishing table. For example, the present invention is applicable to a scroll-type polishing apparatus in which a polishing tool and a workpiece are moved relative to each other with translational circular motion, or a cup-type polishing apparatus.

Although certain preferred embodiments of the present invention have been shown and described in detail, it should be understood that various changes and modifications may be made therein without departing from the scope of the appended claims.

What is claimed is:

1. A polishing tool for polishing a workpiece in a state such that the workpiece is brought into sliding contact with said polishing tool, said polishing tool comprising thermoplastic resin including a first phase having a low glass transition temperature (Tg) of 320 K or lower within a range of from 10 weight % to 90 weight %, and a second phase having a high glass transition temperature (Tg) of 320 K or higher within a range of from 90 weight % to 10 weight %.

2. A polishing tool according to claim 1, wherein said thermoplastic resin comprises linear macromolecules.

3. A polishing tool according to claim 1, wherein said thermoplastic resin is formed as a fixed abrasive element having abrasive particles contained therein.

4. A polishing tool according to claim 1, wherein said thermoplastic resin is formed as a polishing pad having substantially no abrasive particles therein.

5. A polishing tool for polishing a workpiece in a state such that the workpiece is brought into sliding contact with said polishing tool, said polishing tool comprising thermoplastic resin, which is produced by aromatic vinyl type monomers in a range of from 0 weight % to 80 weight %, at least one of acrylic ester type monomers and methacrylic acid ester type monomers in a range of from 0 weight % to 100 weight %, and vinyl type monomers to be copolymerized with said aromatic vinyl type monomers and said at least one of acrylic ester type monomers and methacrylic acid ester type monomers in a range of from 0 weight % to 50 weight %, said thermoplastic resin having a weight average molecular weight ranging from 5,000 to 5,000,000.

6. A polishing tool according to claim 5, wherein said thermoplastic resin comprises linear macromolecules.

7. A polishing tool according to claim 5, wherein said thermoplastic resin is formed as a fixed abrasive element having abrasive particles contained therein.

8. A polishing tool according to claim 5, wherein said thermoplastic resin is formed as a polishing pad having substantially no abrasive particles therein.

9. A polishing apparatus for polishing a workpiece, said polishing apparatus comprising:

a polishing tool; and a top ring for holding and pressing a workpiece against said polishing tool to bring the workpiece into sliding contact with said polishing tool, wherein said polishing tool comprises thermoplastic resin including a first phase having a low glass transition temperature (Tg) of 320 K or lower within a range of from 10 weight % to 90 weight %, and a second phase having a high glass transition temperature (Tg) of 320 K or higher within a range of from 90 weight % to 10 weight %.

10. A polishing apparatus according to claim 9, wherein said thermoplastic resin comprises linear macromolecules.

11. A polishing apparatus according to claim 9, wherein said polishing tool is formed as a fixed abrasive element having abrasive particles contained therein.

12. A polishing apparatus according to claim 9, wherein said polishing tool is formed as a polishing pad having substantially no abrasive particles therein.

13. A polishing apparatus for polishing a workpiece, said polishing apparatus comprising:

a polishing tool; and a top ring for holding and pressing a workpiece against said polishing tool to bring the workpiece into sliding contact with said polishing tool, wherein said polishing tool comprises thermoplastic resin, which is produced by aromatic vinyl type monomers in a range of from 0 weight % to 80 weight %, at least one of acrylic ester type monomers and methacrylic acid ester type monomers in a range of from 0 weight % to 100 weight %, and vinyl type monomers to be copolymerized with said aromatic vinyl type monomers and said at least one of acrylic ester type monomers and methacrylic acid ester type monomers in a range of from 0 weight % to 50 weight %, said thermoplastic resin having a weight average molecular weight ranging from 5,000 to 5,000,000.

14. A polishing apparatus according to claim 13, wherein said thermoplastic resin comprises linear macromolecules.

15. A polishing apparatus according to claim 13, wherein said polishing tool is formed as a fixed abrasive element having abrasive particles contained therein.

16. A polishing apparatus according to claim 13, wherein said polishing tool is formed as a polishing pad having substantially no abrasive particles therein.

17. A polishing method comprising:

bringing a workpiece into sliding contact with a polishing tool, wherein the polishing tool comprises thermoplastic resin including a first phase having a low glass transition temperature (Tg) of 320 K or lower within a range of from 10 weight % to 90 weight %, and a second phase having a high glass transition temperature (Tg) of 320 K or higher within a range of from 90 weight % to 10 weight %.

18. A polishing method comprising:

bringing a workpiece into sliding contact with a polishing tool, wherein the polishing tool comprises thermoplastic resin, which is produced by aromatic vinyl type monomers in a range of from 0 weight % to 80 weight %, at least one of acrylic ester type monomers and methacrylic acid ester type monomers in a range of from 0 weight % to 100 weight %, and vinyl type monomers to be copolymerized with the aromatic vinyl type monomers and the at least one of acrylic ester type monomers and methacrylic acid ester type monomers in a range of from 0 weight % to 50 weight %, the thermoplastic resin having a weight average molecular weight ranging from 5,000 to 5,000,000.

* * * * *